US009675863B2

(12) United States Patent
Vanacore et al.

(10) Patent No.: US 9,675,863 B2
(45) Date of Patent: Jun. 13, 2017

(54) NONOBSTRUCTIONAL GOLF PRACTICE DEVICE

(71) Applicant: SPOT-ON GOLF, LLC, Valencia, CA (US)

(72) Inventors: David Vanacore, Valencia, CA (US); Kenneth William McMahan, Valencia, CA (US); Ammon Michael Kling, Valencia, CA (US)

(73) Assignee: SPOT-ON-GOLF, LLC, Valencia ( * ) Notice: Subject to any disclaimer, the term of this patent is extended or adjusted under 35 U.S.C. 154(b) by 0 days.

(21) Appl. No.: 15/061,998

(22) Filed: Mar. 4, 2016

(65) Prior Publication Data

US 2016/0256761 A1 Sep. 8, 2016

Related U.S. Application Data

(60) Provisional application No. 62/129,304, filed on Mar. 6, 2015.

(51) Int. Cl.
*A63B 69/36* (2006.01)
*A63B 24/00* (2006.01)

(52) U.S. Cl.
CPC ..... *A63B 69/36* (2013.01); *A63B 24/0003* (2013.01)

(58) Field of Classification Search
USPC ..... 473/174, 210, 220, 409
See application file for complete search history.

(56) References Cited

U.S. PATENT DOCUMENTS 3,298,693 A * 1/1967 Eisenberg ..... A63B 69/3632 473/238
3,437,339 A * 4/1969 Starck ..... A63B 69/3608 2/195.1
4,298,201 A * 11/1981 Palinkas ..... A63B 69/3608 473/210
5,197,359 A * 3/1993 Mills ..... B25B 7/00 81/324
5,207,429 A 5/1993 Walmsley et al.
5,527,041 A 6/1996 Terry, III et al.
6,071,202 A 6/2000 Densberger et al.
6,279,433 B1 * 8/2001 Chervenak ..... B25B 7/00 81/177.2

(Continued)

FOREIGN PATENT DOCUMENTS

JP 2009-261893 A 11/2009

*Primary Examiner* — Nini Legesse
(74) *Attorney, Agent, or Firm* — Loza & Loza, LLP; Tyler J. Barrett

(57) ABSTRACT

Golf practice devices are adapted to facilitate practicing without obstructing a putting surface or practice area. According to one example, a golf practice device can include a first base member with a first clamping end and a first handle end, and a second base member with a second clamping end and a second handle end. A portion of the first base member located between the first clamping end and the first handle end may be hingedly coupled to a portion of the second base member located between the second clamping end and the second handle. At least one coupling arm may be pivotably mounted to the first base member, and an attachment feature may be coupled to the first coupling arm. In some examples, a sight or a cell phone with an integrated camera may be coupled to the attachment feature. Other aspects, embodiments, and features are also included.

20 Claims, 10 Drawing Sheets

(56) References Cited

U.S. PATENT DOCUMENTS

| | | | | |
|---|---|---|---|---|
| 6,450,893 | B1 | 9/2002 | Primiano et al. | |
| 6,605,005 | B1 | 8/2003 | Lin | |
| 6,796,910 | B1 * | 9/2004 | Foster | A63B 69/3614 473/220 |
| 7,134,966 | B1 | 11/2006 | Tice | |
| 7,704,153 | B2 | 4/2010 | Loh et al. | |
| 7,803,059 | B2 | 9/2010 | Zhang | |
| 8,962,328 | B2 * | 2/2015 | Cho | C12N 1/20 435/410 |
| 2004/0132555 | A1 | 7/2004 | Forrest | |
| 2005/0272515 | A1 | 12/2005 | Hurley et al. | |
| 2008/0146367 | A1 | 6/2008 | Cruz | |
| 2008/0287206 | A1 | 11/2008 | Kinney | |
| 2013/0085018 | A1 | 4/2013 | Jensen et al. | |

* cited by examiner

NONOBSTRUCTIONAL GOLF PRACTICE DEVICE

PRIORITY CLAIM

The present Application for Patent claims priority to Provisional Application No. 62/129,304 entitled "Universal Clamp and Nonobstructional Golf Practice Device" filed Mar. 6, 2015, the entire disclosure of which is hereby expressly incorporated by reference herein.

TECHNICAL FIELD

The technology discussed below relates generally to golf practicing, and more specifically to methods and devices for facilitating putting practice without obstructing the greens.

BACKGROUND

Golf is premised upon obtaining the lowest score possible by reducing the number of strokes it takes to hit the ball from the tee box, to the fairway and green, and into the cup. Typically, putting (the act of using a putter to "putt" a ball on the surface of a golf green into a cup) results in the single largest number of strokes accounted for during play. On a typical golf course having 18 holes, the number of putting strokes allotted to achieve what is called "par" or even play is 36 strokes with another 36 strokes being allocated toward driving and chipping for a combined total of 72 strokes. Amateurs more often than not exceed this number of putting strokes, while the best professionals typically achieve a substantially less number of strokes. Resultantly, substantial practice on putting greens is spent by amateurs and professionals alike in order to develop their putting skills. This practice includes putting on irregular green surfaces, on contoured putting green surfaces, on flat putting green surfaces; putting uphill, over ridges and on downhill surfaces; and putting at various fixed distances.

In order to practice putting at fixed distances, the "golfer" walks off or measures the distance desired to be practiced. Often the golfer, after determining the distance, will use a tee (a plastic or wood structure) to mark the distance by placing the tee into the putting surface so that multiple practice shots may be taken repeatedly from the same spot in order to hone their skills. By repeatedly practicing from a known distance, the golfer can practice putting distance accuracy so as not to over or under put, and to practice direction accuracy in order to learn the amount of break due to the surface contour associated with that particular putting distance. Unavoidably, the tee placed in the putting surface used to mark the distance creates an obstruction to putting and is also a distraction not normally present when actually putting during a round of golf. When a golfer is done practicing, they tend to leave the tee or tees in the putting surface. The remaining tee or tees present an obstacle to subsequent golfers, who typically have to remove all the remaining tees in order to use the green. Also, the tee marks can cause damage to the putting surface.

BRIEF SUMMARY OF SOME EXAMPLES

The following summarizes some aspects of the present disclosure to provide a basic understanding of the discussed technology. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in summary form as a prelude to the more detailed description that is presented later.

Since physical objects, such as tees, left in a putting surface can create obstacles to subsequent users and/or cause damage to the putting surface, it may be desirable to provide a golf practice device that is capable of eliminating the obstruction caused by using physical objects (e.g., tees), will eliminate the distraction caused by such physical objects, will eliminate the need to walk off a distance, and will leave the putting surface undamaged. Various apparatus and methods described herein provide a golf practice device.

According to one or more aspects of the present disclosure, golf practice devices are disclosed. According to at least one example, a golf practice device may include a first base member with a first clamping end and a first handle end, and a second base member with a second clamping end and a second handle end. A portion of the first base member located between the first clamping end and the first handle end may be hingedly coupled to a portion of the second base member located between the second clamping end and the second handle. At least one coupling arm may be pivotably mounted to the first base member, and an attachment feature may be coupled to the first coupling arm. In some examples, a sight or a cell phone with an integrated camera may be coupled to the attachment feature.

Additional aspects of the present disclosure relate to methods of making a golf practice device. According to one or more implementations, such methods may include forming a first base member including a first clamping end and a first handle end, and a second base member including a second clamping end and a second handle end. A portion of the first base member located between the first clamping end and the first handle end may be hingedly coupled to a portion of the second base member located between the second clamping end and the second handle end. A first coupling arm may be pivotably mounted to the first base member, and a first attachment feature may be coupled to the first coupling arm.

Other aspects, features, and embodiments associated with the present disclosure will become apparent to those of ordinary skill in the art upon reviewing the following description in conjunction with the accompanying figures.

DRAWINGS

DETAILED DESCRIPTION

The description set forth below in connection with the appended drawings is intended as a description of various configurations and is not intended to represent the only configurations in which the concepts and features described herein may be practiced. The following description includes specific details for the purpose of providing a thorough understanding of various concepts. However, it will be apparent to those skilled in the art that these concepts may be practiced without these specific details. In some instances, well known structures, techniques and components may be shown in block diagram form to avoid obscuring the described concepts and features.

The illustrations presented herein are, in some instances, not necessarily actual views of any particular golf practice device, components of a golf practice device, a sight, or a cell phone/video camera, but are merely idealized representations which are employed to describe the present disclosure. Additionally, elements common between figures may retain the same numerical designation.

Figure 1:
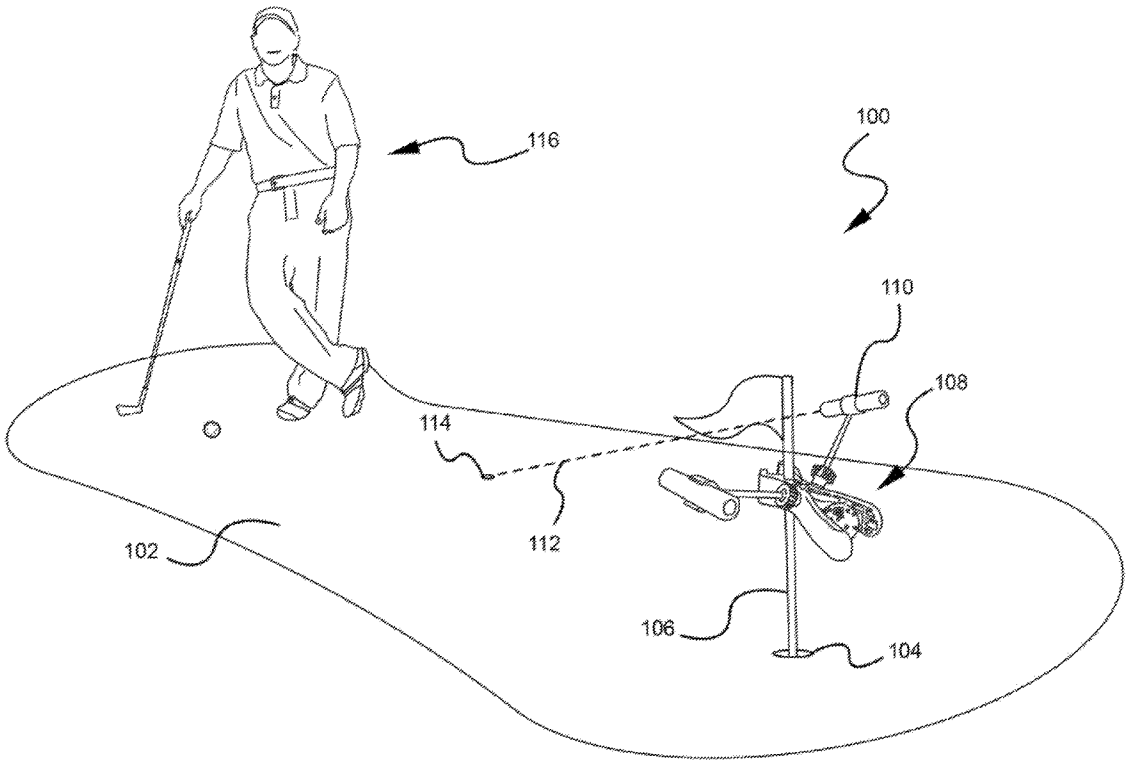
FIG. 1 is an example of an environment in which one or more aspects of the present disclosure may find application.

Various embodiments of this disclosure pertain to a golf practice device. FIG. 1 illustrates an example of an environment in which one or more aspects of the present disclosure may find application. For purpose of clarity, not all components of the golf practice device may be shown. As shown in FIG. 1, a golf putting area 100 is shown, including a putting surface (or putting green) 102, a cup 104, and a pole 106 vertically positioned in the cup 104. A golf practice device 108 is coupled to the pole 106. In the example shown, the golf practice device 108 includes a sight 110 projecting a light (indicated by the light source trajectory 112) onto the putting surface 102. The projected light 112 provides a visible indicator 114 at a location on the putting surface 102. According to aspects of the present disclosure, the visible indicator 114 may be placed anywhere upon the putting surface 102, for instance, to enable a person 116 to mark a spot on the putting surface for putting practice purposes.

Figure 2:
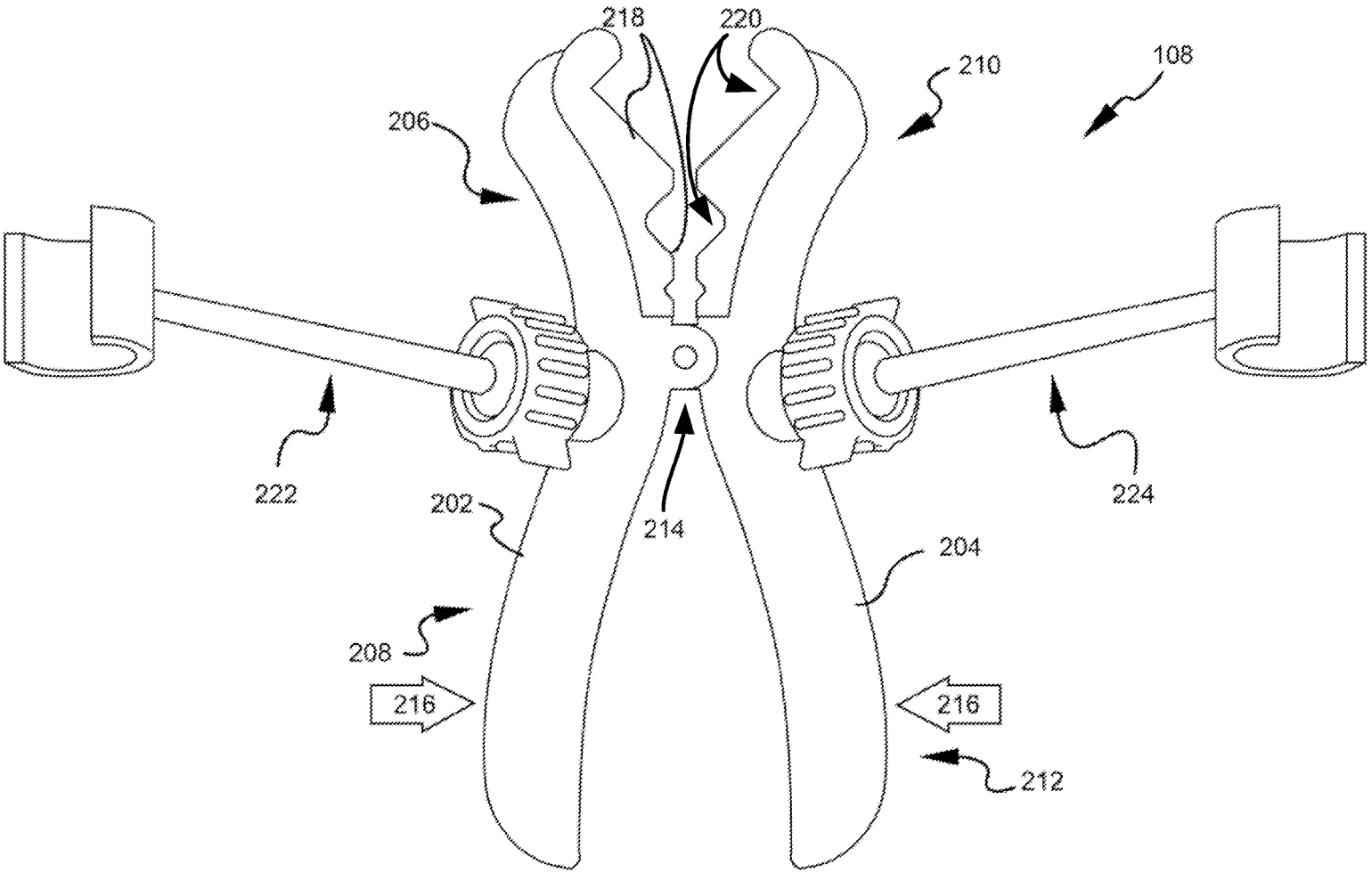
FIG. 2 illustrates a side view of a golf practice device according to at least one example of the disclosure.

Turning to FIG. 2, a side view of a golf practice device 108 according to at least one example of the disclosure is illustrated. As shown, the golf practice device 108 includes a first base member 202 and a second base member 204 pivotably coupled together. Both the first base member 202 and the second base member 204 include a clamping end and a handle end. For instance, the first base member 202 includes a first clamping end 206 and a first handle end 208, and the second base member 204 includes a second clamping end 210 and a second handle end 212. The components of the first and second base members 202, 204 may be any suitable material. By way of example only, components of the first and second base members 202, 204 may be a plastic, metal (ferrous or nonferrous), or other material.

The first base member 202 and the second base member 204 can be pivotably coupled together with a hinged connection 214 located between the first clamping end 206 and first handle end 208 of the first base member 202, and between the second clamping end 210 and second handle end 212 of the second base member 204. In at least some embodiments, a torsion spring (not shown) may be included and positioned between the first and second base members 202, 204 to cause the two base members 202, 204 to rotate toward each other at the first and second clamping ends 206, 210 while rotating apart from each other at the first and second handle ends 208, 212.

When a force is placed generally in the direction of arrows 216 on the first and second handle ends 208, 212 of the first and second base members 202, 204 sufficient to bring the first and second handle ends 208, 212 toward each other, the first and second clamping ends 206, 210 separate, and can be positioned around an object. When the force on the first and second handle ends 208, 212 is released or decreased, the spring causes the first and second handle ends 208, 212 to separate from one another and causes the first and second clamping ends 206, 210 to come together, enabling the first and second clamping ends 206, 210 to clamp to an object.

As illustrated, the first and second clamping ends 206, 210 may include one or more tooth-like projections 218 forming one or more openings 220. In at least some embodiments, the tooth-like projections 218 may be sized and configured to form differently-sized openings 220. The differently-sized openings 220 can facilitate attaching the first and second clamping ends 206, 210 to various sized and shaped objects. In the example shown in FIG. 2, there are three differently-sized openings 220, with a smallest opening 220 closest to the hinged connection 214, and a largest opening 220 farthest from the hinged connection 214.

Figure 3:
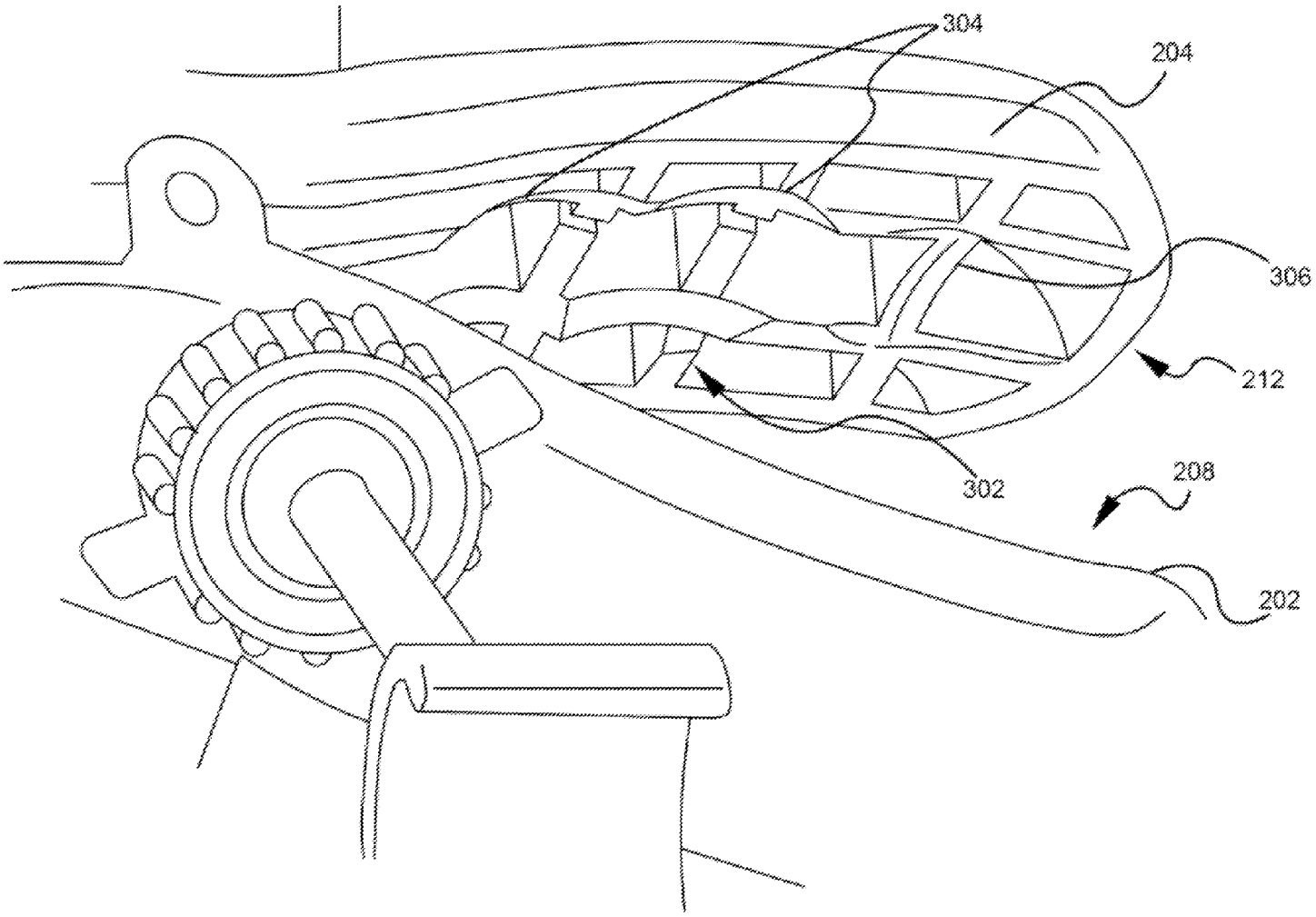
FIG. 3 is a partial isometric view of the golf practice device from FIG. 2 illustrating an indentation feature according to at least one example of the disclosure.

In some embodiments, the first and second handle ends 208, 212 of the first and second base members 202, 204 may include an indentation feature. For example, FIG. 3 is a partial isometric view of the golf practice device 108 from FIG. 2 illustrating an indentation feature 302 according to at least one example. As shown, the indentation feature 302 includes two arcuate depressions 304 on a surface 306 of the second handle end 212 that faces toward the first handle end 208. Although not visible, the first handle end 208 also includes similar arcuate depressions on an inside surface facing toward the second handle end 212.

Figure 4:
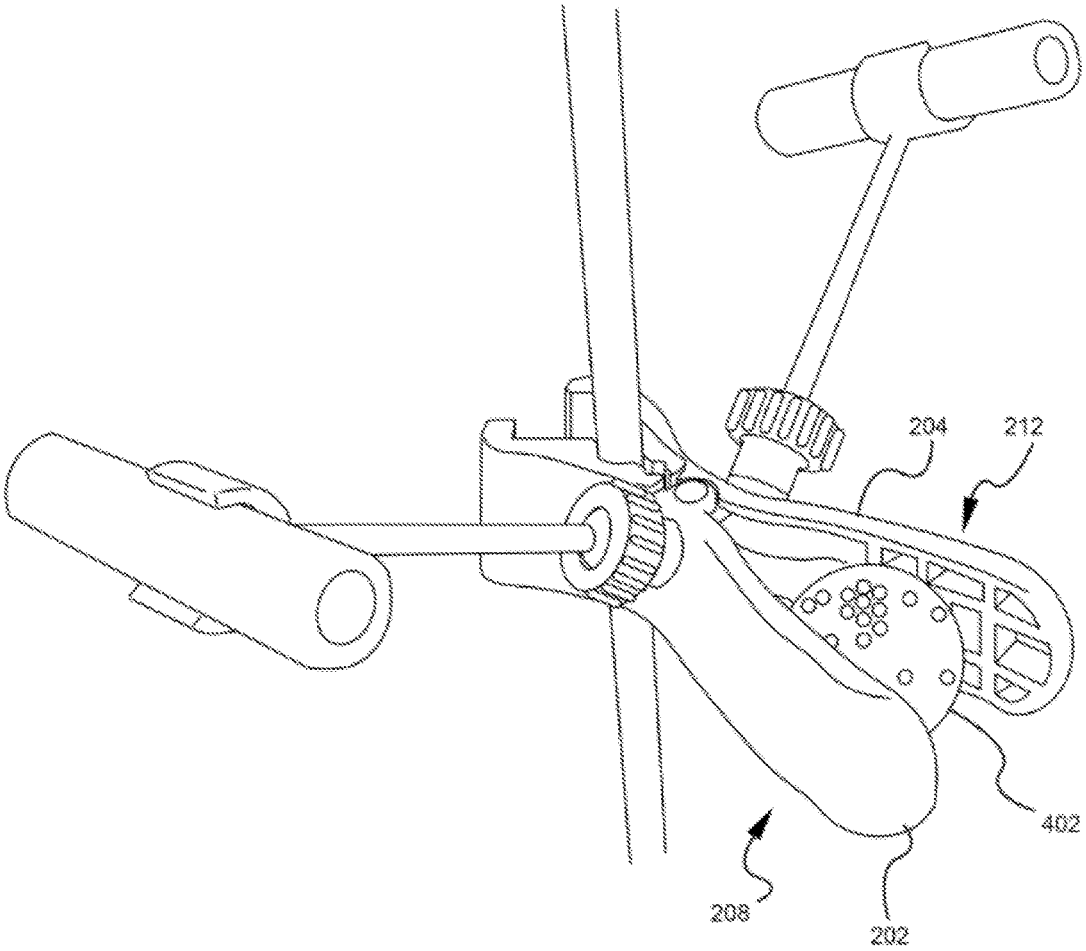
FIG. 4 is an isometric view of the golf practice device of FIG. 2 with a golf ball positioned in an indentation feature between the first and second handle ends of the first and second base members.

According to one or more embodiments, the arcuate depressions 304 of the indentation feature 302 may be sized and configured to receive a spherical object like a ball to provide clamping force in addition to the spring, and in excess of what the spring may typically provide. For example, FIG. 4 shows a golf ball 402 positioned between the first and second handle ends 208, 212 of the first and second base members 202, 204, and at least partially retained by one of the described arcuate depressions 304 of the indentation feature 302 depicted in FIG. 3. The additional clamping force provided by the ball 402 can enable the first and second clamping ends 206, 210 of the first and second base members 202, 204 to clamp together with sufficient force to securely clamp to many differently sized and shaped objects. In the embodiment depicted in FIG. 3, the indentation feature 302 includes two sets of arcuate depressions 304. In such an embodiment, the golf ball 402 in FIG. 4 may be placed in either of the two sets of arcuate depressions 304, with the set of arcuate depressions 304 closest to the hinged connection 214 resulting in greater force on the first and second handle ends 208, 212 than the set of arcuate depressions 304 farthest from the hinged connection 214.

Referring back to FIG. 2, the golf practice device 108 also includes one or more coupling arms mounted to one or both base members 202, 204. For example, in FIG. 2 a first coupling arm 222 is mounted to the first base member 202, and a second coupling arm 224 is mounted to the second base member 204. Although the depicted example shows a coupling arm mounted to each of the first and second base members 202, 204, it should be apparent that one of the first or second base members 202, 204 may have no coupling arms mounted thereto in some embodiments, or one or both of the first and second base members 202, 204 may have more than one coupling arm mounted thereto in some embodiments. In the depicted example, the first coupling arm 222 and the second coupling arm 224 are each mounted at least substantially on the handle end 208, 212 of the respective base member 202, 204. In some embodiments, the mounting location on one or more base members 202, 204 may vary between the handle end and the clamping end.

Figure 5:
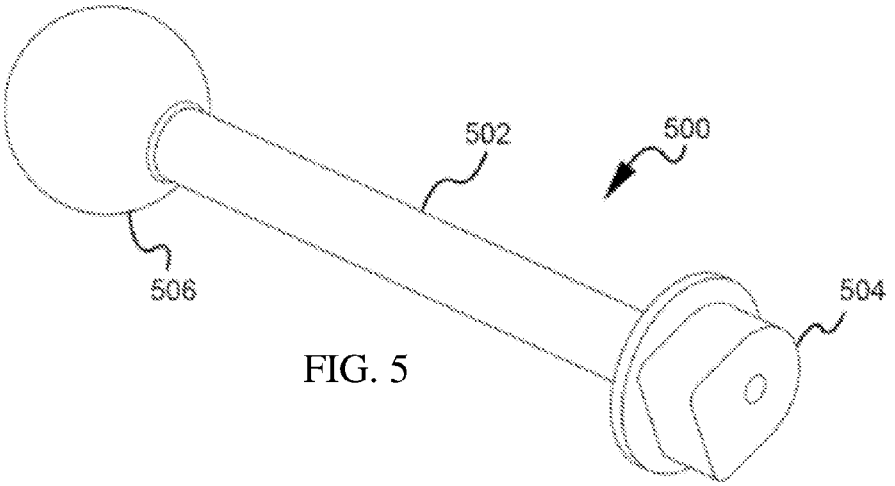
FIG. 5 is an isometric view of a coupling arm according to at least one example of the disclosure.

The first and second coupling arms 222, 224 are configured to couple one or more devices or objects to the golf practice device 108. Referring to FIG. 5, a coupling arm 500 may include a shaft 502 with a connector 504 at one longitudinal end and a pivot component 506 at the opposite longitudinal end. The shaft 502 may be at least substantially rigid in some embodiments, or the shaft 502 may be flexible in other embodiments. For example, the shaft 502 may be formed of a rigid plastic or metal material in some embodiments, or the shaft 502 may be formed of a flexible wire or other flexible material in other embodiments.

The connector 504 is configured to couple various attachment features to the coupling arm 500. The different attachment features are configured to facilitate receiving and retaining various devices or objects. Some non-limiting examples of attachment features are depicted in FIGS. 6 and 7.

Figure 6:
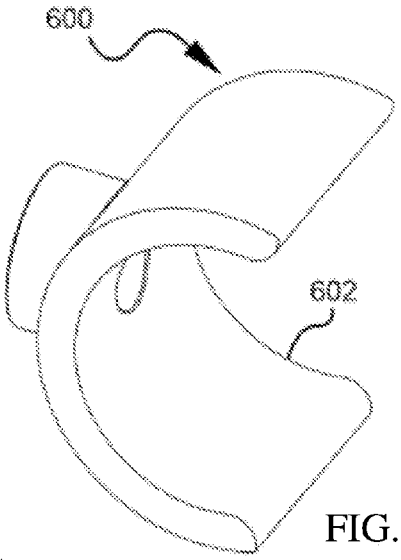
FIG. 6 is an isometric view of an embodiment of an attachment feature according to one example of the disclosure.

In FIG. 6, the attachment feature 600 is configured to receive and retain any cylindrically shaped object sized to fit within the attachment feature 600. The attachment feature 600 generally includes a c-shaped clip 602. In at least one example, the depicted attachment feature 600 can receive and retain a laser, a flashlight, or other similarly shaped object. Similarly, an object with a cylindrical portion may also be received and retained by the attachment feature 600.

Figure 7:
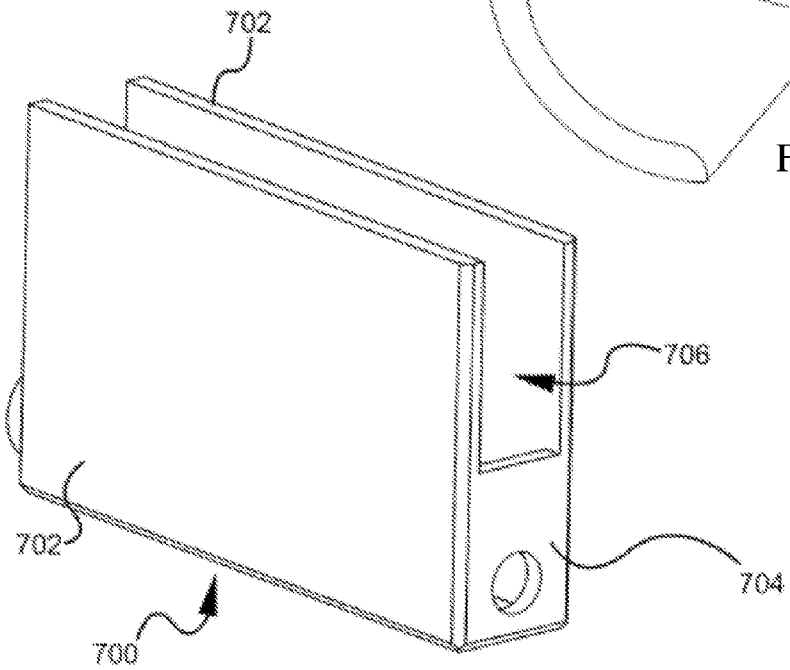
FIG. 7 is an isometric view of another embodiment of an attachment feature according to one example of the disclosure.

In FIG. 7, the attachment feature 700 is configured to receive and retain a cell phone, camera, or other similarly shaped object. As shown, the attachment feature 700 includes two parallel sidewalls 702 and endwalls 704 extending between the two sidewalls 702. The two endwalls 704 do not extend as high as the two sidewalls 702, resulting in a slot 706. With this configuration, a cell phone with a camera, or a stand-alone camera can be received and retained by the attachment feature 700 in either of a portrait orientation or landscape orientation.

Other attachment features can also be employed, with different attachment features configured to receive and retain different objects, such as a cell phone, a cigar, a camera, a golf ball, a tee, a ball marker, etc.

Figure 8:
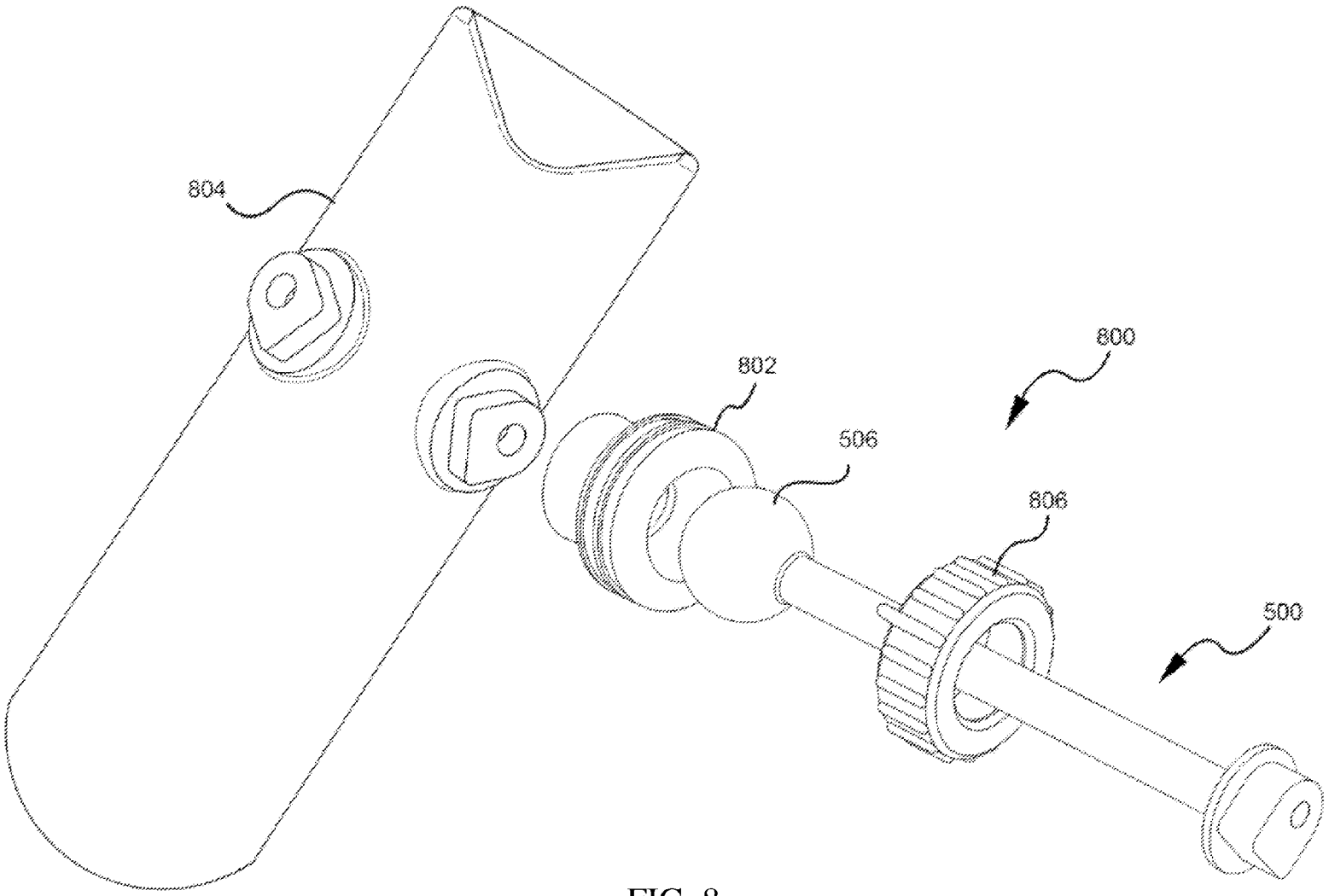
FIG. 8 is an isometric exploded view of a ball socket connection assembly according to at least one example.

As noted above, referring to FIG. 5, the coupling arm 500 includes a pivot component 506 to facilitate movement of the coupling arm 500 with relation to the base member to which it is mounted. In the example shown, the pivot component 506 is configured as a ball-shaped end. This ball-shaped pivot component 506 can be employed as part of a ball socket connection to enable the coupling arm 500 to pivot in several directions in relation to the base member, as well as to rotate in relation to the base member. FIG. 8 is an isometric exploded view of a ball socket connection assembly 800 according to at least one example. As shown, a ball socket 802 can be coupled to a base member 804 (e.g., the first base member 202 or second base member 204). The ball-shaped pivot component 506 can be positioned in the ball socket 802, and a ball nut 806 is positioned over the ball-shaped pivot component 506 and screwed onto threads of the ball socket 802.

Figure 12:
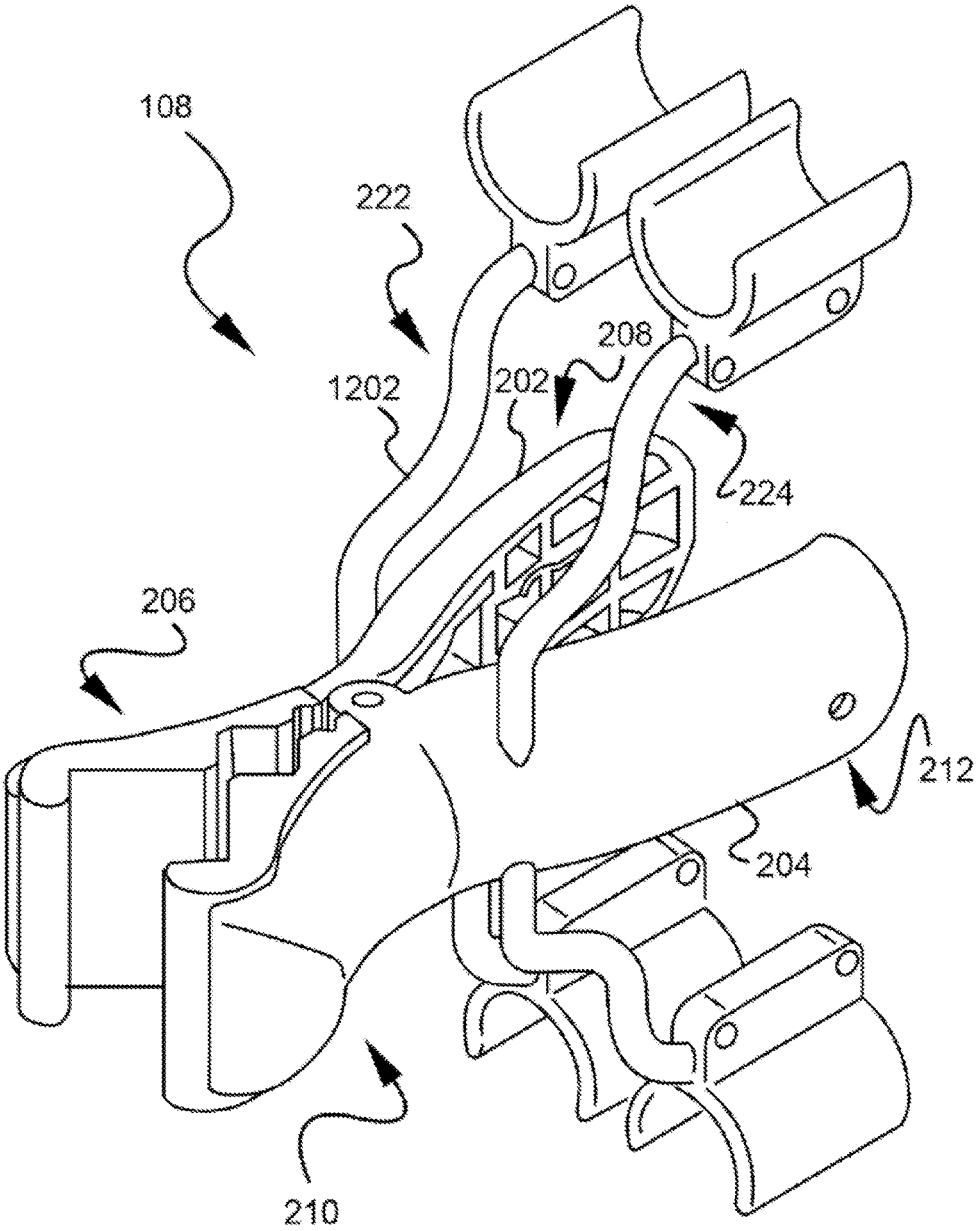
FIG. 12 illustrates an isometric view of a golf practice device according to at least one additional example of the disclosure.

As noted above, the coupling arms 500 may include a flexible shaft 502 in some embodiments. Some of such examples may still include a pivot component, such as the pivot component 506 described above, but other embodiments may be configured with the flexible shaft 502 representing the pivot component. For example, FIG. 12 is an isometric view of a golf practice device 108 according to such an embodiment. As shown, the first coupling arm 222 and the second coupling arm 224 (as well as third and fourth coupling arms in this example) include a flexible shaft 1202 coupled to respective first and second base members 202, 204. The flexible coupling arms 222, 224 may, in at least some embodiments, be formed from a flexible wire material coupled to an aperture in the respective first or second base member 202, 204. A user can pivot the flexible shaft to position the first and second coupling arms 222, 224 as desired during use.

Figure 9:
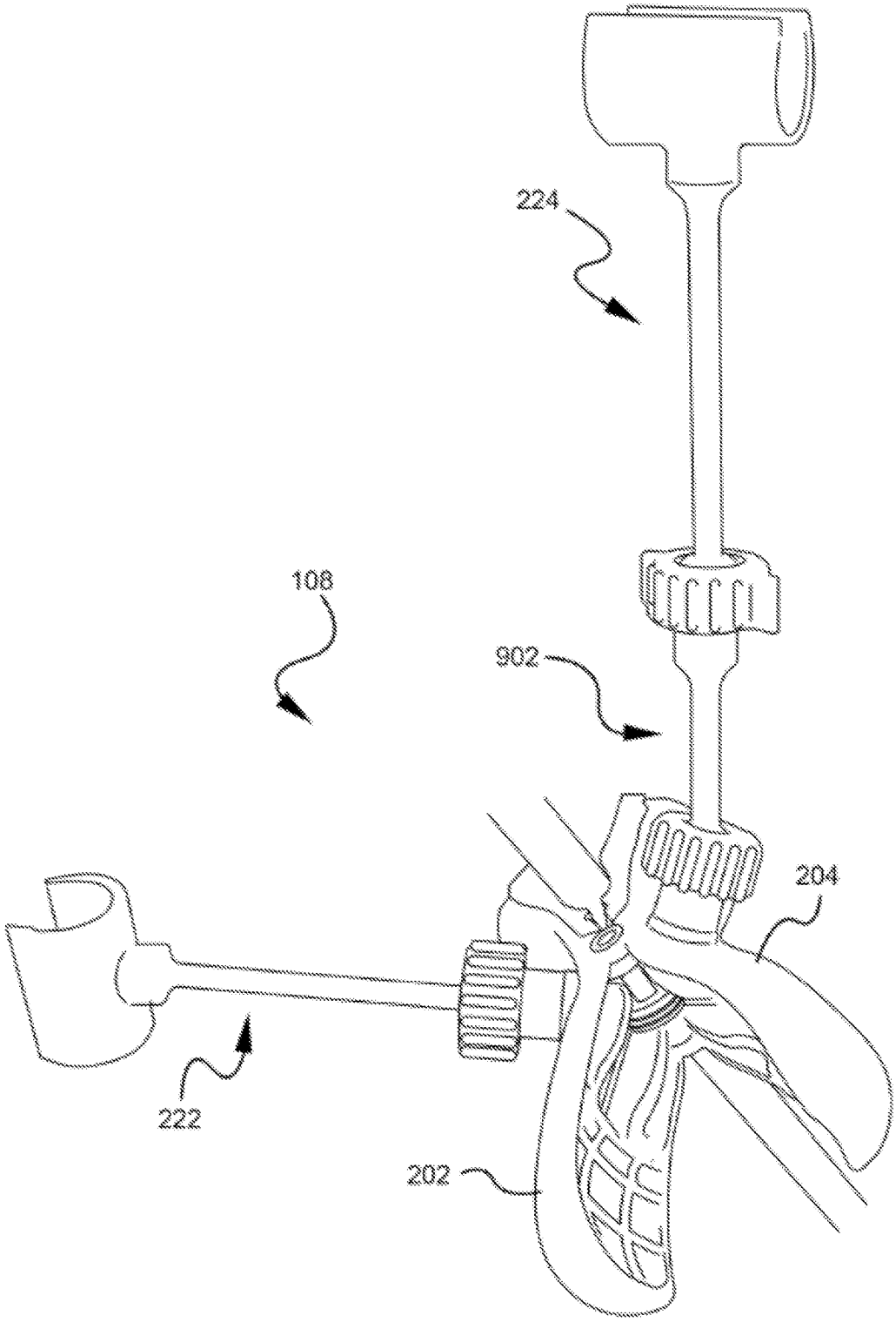
FIG. 9 is an isometric view of a golf practice device employing multiple coupling arms mounted to each other.

In some embodiments, multiple coupling arms 500 can be connected to each other to increase the extension from the base member and/or to provide different ranges of motion. FIG. 9 is an isometric view of a golf practice device 108 employing multiple coupling arms mounted to each other. As shown, the golf practice device 108 includes a first coupling arm 222 mounted to the first base member 202. On the second base member 204, an extension coupling arm 902 is mounted to the second base member 204 and to the second coupling arm 224. In this example, the extension coupling arm 902 is mounted to the second base member 204 as part of a ball socket connection assembly, such as the ball socket connection assembly 800 described above with reference to FIG. 8. The extension coupling arm 902 also includes an attachment feature configured as a ball socket, such as the ball socket 802 depicted in FIG. 8. A ball-shaped pivot component of the second coupling arm 224 can be positioned in the attachment feature of the extension coupling arm 902 configured as a ball socket, and a ball nut can be positioned over the ball-shaped pivot component and screwed onto threads of the ball socket, as described above with reference to FIG. 8. A person of ordinary skill in the art will understand that additional extension coupling arms 902 can be connected together in a string of components as desired.

In operation, the golf practice device 108 can be coupled to an object by clamping the first and second clamping ends 206, 210 to the object. Further, one or more objects can be coupled to one or more attachment features to provide some feature to a user. For example, as depicted in FIG. 1, the golf practice device 108 can be coupled to a pole 106 in a cup 104 of a golf putting area 100. A sight 110 can be received and retained by an attachment feature, such as the attachment feature 600 in FIG. 6. By pivoting the coupling arm to which the sight 110 is coupled, the sight 110, such as a laser, can be aimed to position a visible indicator 114 on a portion of the putting surface 102. A person 116 can then use the position of the visible indicator 114 to mark a location for practicing putting on the golf putting area 100.

In some examples, a second sight can be received and retained by another attachment feature, and a second visible indicator (not shown) can be aimed on another portion of the putting surface 102. In this way, a person 116 can also mark a target location to hit towards to properly play a break or slope on the putting surface 102. The person 116 can accordingly practice different variables for the break by hitting balls at different speeds toward the second visible indicator, where a faster speed could go below the second visible indicator and a slower speed could go above the second visible indicator.

Figure 10:
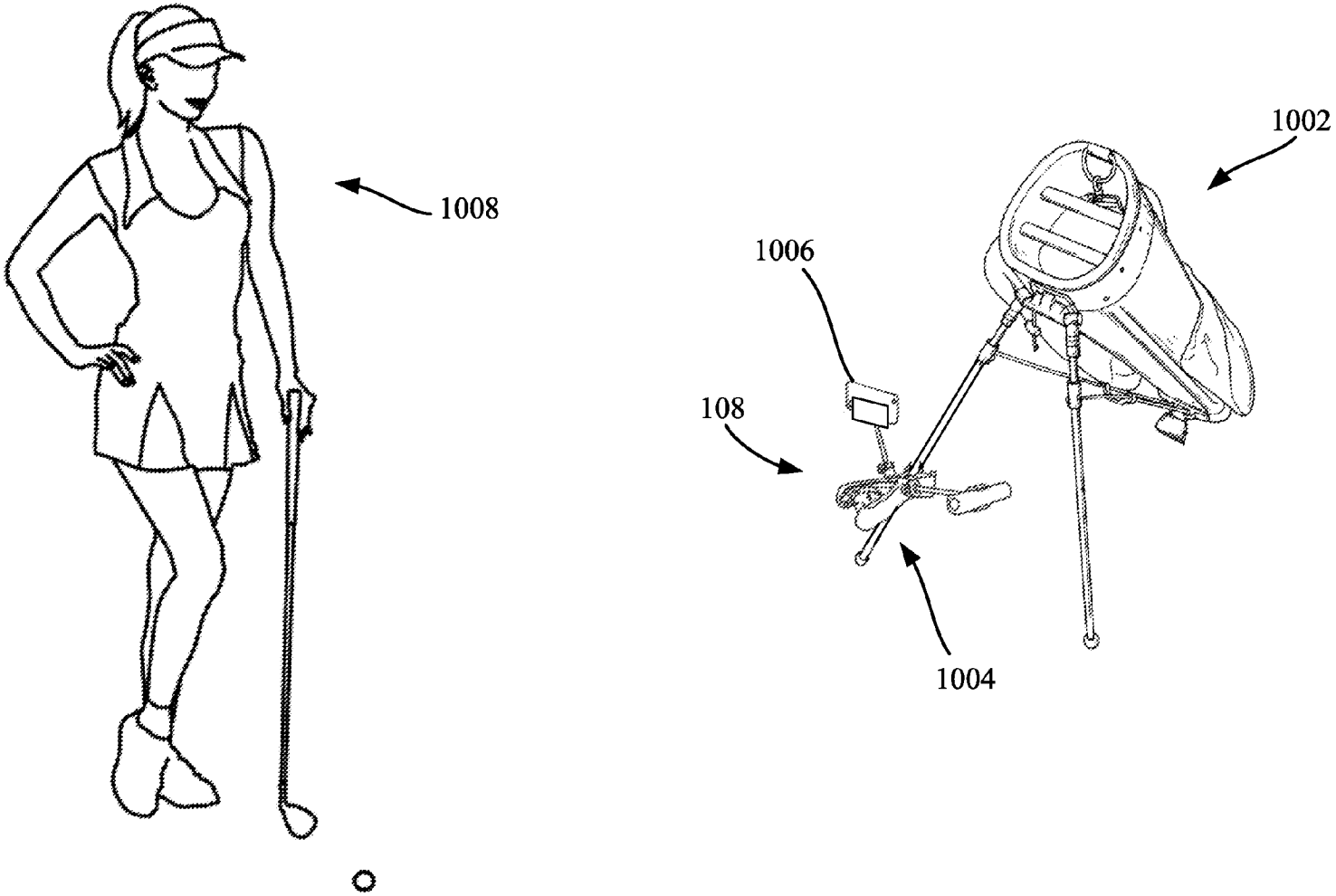
FIG. 10 is another example of an environment in which one or more aspects of the present disclosure may find application.

In another example, as depicted in FIG. 10, the golf practice device 108 can be coupled to a portion of a golf bag 1002, such as a support leg 1004 of the golf bag 1002. In this example, the attachment feature may be configured like the attachment feature 700 in FIG. 6, and a cell phone/video camera 1006 can be received and retained by the attachment feature. A user 1008 can pivot the coupling arm to which the cell phone/video camera 1006 is coupled to aim a camera at the user 1008 and record video or take photos of the user 1008 while practicing.

Figure 11:
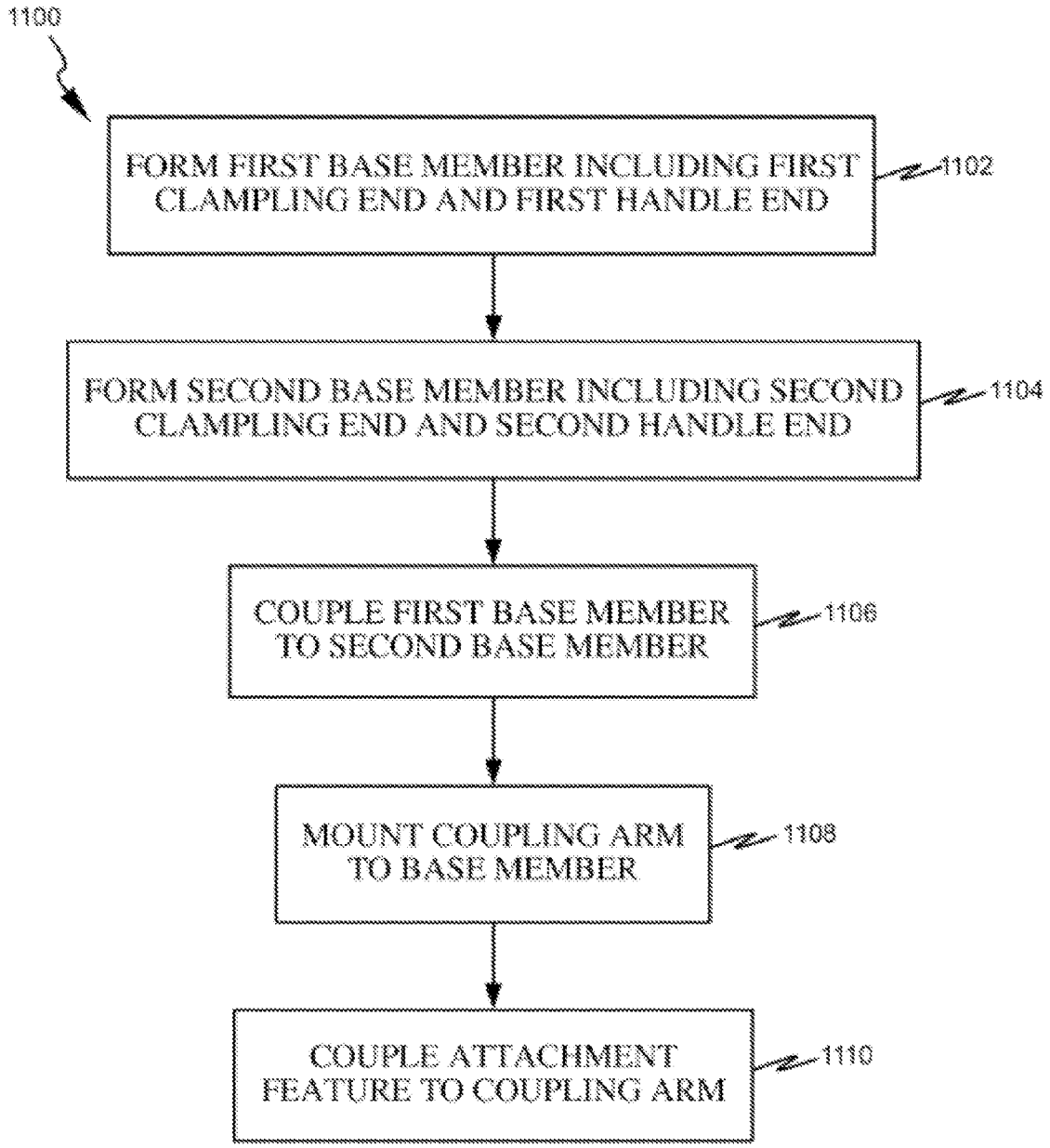
FIG. 11 is a flow diagram illustrating a method of making a golf practice device according to at least one implementation.

Additional embodiments of the present disclosure relate to methods of making a golf practice device, such as the golf practice device 108. FIG. 11 is a flow diagram illustrating a method 1100 of making a golf practice device according to at least one implementation. With reference to FIGS. 2, 11, and 12, a first base member 202 including a first clamping end 206 and a first handle end 208 can be formed at 1102, and a second base member 204 including a second clamping end 210 and a second handle end 212 can be formed at 1104. The first and second base members 202, 204 can be formed of any suitable material, such as a plastic or metal. In at least one implementation, the first and second base members 202, 204 are formed from injection molding a plastic material, and attaching an elastomeric material forming projections 218 on the first and second clamping ends 206, 210. In one or more implementations, forming the first and second base members 202, 204 can include forming an indentation feature 302 in the first and second handle ends 208, 212, as described above with reference to FIGS. 3 & 4.

At 1106, the first base member 202 can be coupled to the second base member 204. For example, the first base member 202 and the second base member 204 can be hingedly coupled together with a hinged connection 214 located between the first clamping end 206 and first handle end 208 of the first base member 202, and between the second clamping end 210 and second handle end 212 of the second base member 204. In at least some implementations, hingedly coupling the first and second base members 202, 204 can include positioning a torsion spring between the first and second base members 202, 204 as described above.

At 1108, at least one coupling arm can be mounted to at least one of the first base member 202 or the second base member 204. For example, a first coupling arm 222 may be mounted to the first base member 202. As described above with reference to FIG. 8, a coupling arm 500 can be pivotably mounted to a base member 804 with a ball socket connection assembly 800. More particularly, a ball-shaped pivot component 506 can be positioned in a ball socket 802, and a ball nut 806 can be positioned over the ball-shaped pivot component 506 and screwed onto threads of the ball socket 802. In other embodiments, as described above with reference to FIG. 12, a coupling arm 222, 224 formed at least in part from a flexible wire can be coupled to an aperture in a base member 202, 204.

In some implementation, mounting a coupling arm to a base member may include mounting the coupling arm to an extension coupling arm that is then mounted to the base member, such as the second coupling arm 224 and extension coupling arm 902 described above with reference to FIG. 9.

At 1110, an attachment feature can be coupled to the coupling arm. For example, an attachment feature such as the attachment feature 600 or the attachment feature 700 can be coupled to the connector 504 of the coupling arm 500, as described above with reference to FIGS. 5, 6, and 7.

While the above discussed aspects, arrangements, and embodiments are discussed with specific details and particularity, one or more of the components, steps, features and/or functions illustrated in FIGS. 1, 2, 3, 4, 5, 6, 7, 8, 9, 10, 11, and/or 12 may be rearranged and/or combined into a single component, step, feature or function or embodied in several components, steps, or functions. Additional elements, components, steps, and/or functions may also be added or not utilized without departing from the present disclosure.

Also, it is noted that at least some implementations have been described as a process that is depicted as a flowchart or flow diagram. Although a flowchart may describe the operations as a sequential process, many of the operations can be performed in parallel or concurrently. In addition, the order of the operations may be re-arranged. A process is terminated when its operations are completed.

While features of the present disclosure may have been discussed relative to certain embodiments and figures, all embodiments of the present disclosure can include one or more of the advantageous features discussed herein. In other words, while one or more embodiments may have been discussed as having certain advantageous features, one or more of such features may also be used in accordance with any of the various embodiments discussed herein. In similar fashion, while exemplary embodiments may have been discussed herein as device, system, or method embodiments, it should be understood that such exemplary embodiments can be implemented in various devices, systems, and methods.

The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other.

The various features associate with the examples described herein and shown in the accompanying drawings can be implemented in different examples and implementations without departing from the scope of the present disclosure. Therefore, although certain specific constructions and arrangements have been described and shown in the accompanying drawings, such embodiments are merely illustrative and not restrictive of the scope of the disclosure, since various other additions and modifications to, and deletions from, the described embodiments will be apparent to one of ordinary skill in the art. Thus, the scope of the disclosure is only determined by the literal language, and legal equivalents, of the claims which follow.

What is claimed is:

1. A golf practice device, comprising:

a first base member with a first clamping end and a first handle end;

a second base member with a second clamping end and a second handle end, wherein a portion of the second base member located between the second clamping end and the second handle end is hingedly coupled to a portion of the first base member located between the first clamping end and the first handle;

a first coupling arm comprising an elongated shaft pivotably mounted to the first base member and with a free end extending away from the first base member; and a first attachment feature coupled to the free end of the shaft of the first coupling arm, the first attachment feature comprising a clip sized and shaped to connect a sight that projects a light onto a surface.

2. The golf practice device of claim 1, further comprising:

a second coupling arm pivotably mounted to the second base member; and a second attachment feature coupled to the second coupling arm.

3. The golf practice device of claim 2, wherein the second attachment feature comprises a clip sized and shaped to connect a cylindrically shaped device.

4. The golf practice device of claim 2, wherein the second attachment feature comprises two parallel sidewalls spaced sufficiently to receive a cell phone therebetween, and at least one endwall extending between the two sidewalls.

5. The golf practice device of claim 1, wherein the first coupling arm is pivotably mounted to the first handle end of the first base member.

6. The golf practice device of claim 1, wherein the first coupling arm comprises an at least substantially rigid shaft.

7. The golf practice device of claim 1, wherein the first coupling arm is pivotably mounted to the first base member by flexible shaft that is bent by a user to position the first coupling arm.

8. The golf practice device of claim 1, further comprising an extension coupling arm pivotably mounted between the first coupling arm and the first base member.

9. The golf practice device of claim 1, further comprising an indentation feature comprising an arcuate depression on an inside surface of the first handle end of the first base member and an arcuate depression on an inside surface of the second handle end of the second base member.

10. A golf practice device, comprising:

a first base member with a first clamping end and a first handle end;

a second base member with a second clamping end and a second handle end, wherein a portion of the second base member located between the second clamping end and the second handle end is pivotably coupled to a portion of the first base member located between the first clamping end and the first handle end;

a first coupling arm pivotably mounted to the first base member;

a first attachment feature comprising a clip coupled to the first coupling arm; and a sight configured to project a light onto a surface, wherein the sight is directly coupled to the clip of the first attachment feature.

11. The golf practice device of claim 10, further comprising:

a second coupling arm pivotably mounted to the second base member; and a second attachment feature coupled to the second coupling arm.

12. The golf practice device of claim 11, wherein the second attachment feature comprises two parallel sidewalls spaced sufficiently to receive a cell phone therebetween, and at least one endwall extending between the two sidewalls.

13. The golf practice device of claim 10, further comprising:

an indentation feature comprising an arcuate depression on an inside surface of the first handle end of the first base member and an arcuate depression on an inside surface of the second handle end of the second base member.

14. A method of making a golf practice device, comprising:

forming a first base member comprising a first clamping end and a first handle end;

forming a second base member comprising a second clamping end and a second handle end;

hingedly coupling a portion of the first base member located between the first clamping end and the first handle end to a portion of the second base member located between the second clamping end and the second handle end;

pivotably mounting a first coupling arm to the first base member, wherein the first coupling arm comprises an elongated shaft with a free end extending away from the first base member; and coupling a first attachment feature to the free end of the first coupling arm, the first attachment feature comprising a clip sized and shaped to retain a sight that projects a light onto a surface.

15. The method of claim 14, further comprising:

pivotably mounting a second coupling arm to the second base member; and coupling a second attachment feature to the second coupling arm.

16. The method of claim 15, wherein coupling the second attachment feature to the second coupling arm comprises:

coupling to the second coupling arm the second attachment feature comprising two parallel sidewalls spaced sufficiently to receive a cell phone therebetween, and at least one endwall extending between the two sidewalls.

17. The method of claim 14, wherein:

forming the first base member further comprises forming the first base member to include an indentation feature comprising an arcuate depression on a surface of the first handle end; and forming the second base member further comprises forming the second base member to include an indentation feature comprising an arcuate depression on a surface of the second handle end.

18. The method of claim 14, wherein pivotably mounting the first coupling arm to the first base member comprises:

pivotably mounting the first coupling arm to an extension coupling arm; and pivotably mounting the extension coupling arm to the first base member.

19. The method of claim 14, wherein pivotably mounting the first coupling arm to the first base member comprises:

employing a ball socket connection assembly to pivotably mount the first coupling arm to the first base member.

20. The method of claim 14, wherein pivotably mounting the first coupling arm to the first base member comprises:

coupling the first coupling arm to the first base member with a flexible shaft that is bent by a user to position the first coupling arm as desired.

* * * * *